US009683816B2

(12) United States Patent
Dry

(10) Patent No.: US 9,683,816 B2
(45) Date of Patent: Jun. 20, 2017

(54) SELF-REPAIRING ARMOR

(71) Applicant: Carolyn Dry, Winona, MN (US)

(72) Inventor: Carolyn Dry, Winona, MN (US)

(73) Assignee: Carolyn Dry, Winona, MN (US)

( * ) Notice: Subject to any disclaimer, the term of this patent is extended or adjusted under 35 U.S.C. 154(b) by 0 days.

(21) Appl. No.: 14/847,940

(22) Filed: Sep. 8, 2015

(65) Prior Publication Data

US 2016/0195367 A1 Jul. 7, 2016

Related U.S. Application Data

(60) Provisional application No. 62/070,826, filed on Sep. 8, 2014, provisional application No. 62/178,013, filed on Mar. 30, 2015, provisional application No. 62/230,366, filed on Jun. 5, 2015.

(51) Int. Cl.
*F41H 5/007* (2006.01)
*F41H 5/04* (2006.01)

(52) U.S. Cl.
CPC ..... *F41H 5/0428* (2013.01); *F41H 5/007* (2013.01)

(58) Field of Classification Search
CPC ..... F41H 5/007; F41H 5/04; F41H 5/0414; F41H 5/0428; F41H 5/0435
USPC ..... 89/36.02, 36.04–36.09, 36.11–36.13
See application file for complete search history.

(56) References Cited

U.S. PATENT DOCUMENTS 5,530,037 A 6/1996 McDonnell et al.
5,561,173 A 10/1996 Dry
5,660,624 A 8/1997 Dry
5,677,029 A * 10/1997 Prevorsek ..... B32B 5/12 428/105
5,803,963 A 9/1998 Dry
5,989,334 A 11/1999 Dry
6,261,360 B1 7/2001 Dry
6,527,849 B2 3/2003 Dry
6,642,337 B1 11/2003 Misiak et al.
7,022,179 B1 4/2006 Dry
7,811,666 B2 10/2010 Dry
8,685,513 B1 4/2014 Dry
8,721,959 B2 5/2014 Dry
8,877,309 B1 11/2014 Dry
2004/0007784 A1* 1/2004 Skipor ..... B01J 13/02 257/788
2006/0065111 A1* 3/2006 Henry ..... F41H 5/0492 89/36.02

(Continued)

FOREIGN PATENT DOCUMENTS

WO WO-2007/005657 1/2007

*Primary Examiner* — Bret Hayes
(74) *Attorney, Agent, or Firm* — Foley & Lardner LLP

(57) ABSTRACT

The present technology provides armor articles for use in body armor, vehicle armor, and aircraft armor, including helicopters. The armor articles include a ceramic plate having a front surface and a rear surface; a polymer backer affixed to the rear surface of the ceramic plate, wherein the polymer backer comprises a laminate of at least two layers of material, each layer comprising a ballistic fabric; and self-repair conduits on the front surface of the ceramic plate and covered by a layer of material, wherein the self-repair conduits contain a self-repair composition. The present armor articles are light weight yet can still sustain multiple hits by armor piercing bullets. Armor articles may also be produced without the ceramic plate.

27 Claims, 1 Drawing Sheet

(56) References Cited

U.S. PATENT DOCUMENTS

| | | | | |
|---|---|---|---|---|
| 2007/0087198 | A1* | 4/2007 | Dry | B29C 73/22 428/408 |
| 2010/0300275 | A1* | 12/2010 | Warren | F41H 5/0492 89/36.02 |
| 2012/0000352 | A1* | 1/2012 | Warren | F41H 5/007 89/36.02 |
| 2012/0251835 | A1* | 10/2012 | Dry | B29C 73/22 428/454 |
| 2014/0230638 | A1 | 8/2014 | Waldrop | |
| 2015/0214609 | A1* | 7/2015 | Dry | H01Q 1/1271 343/904 |

* cited by examiner

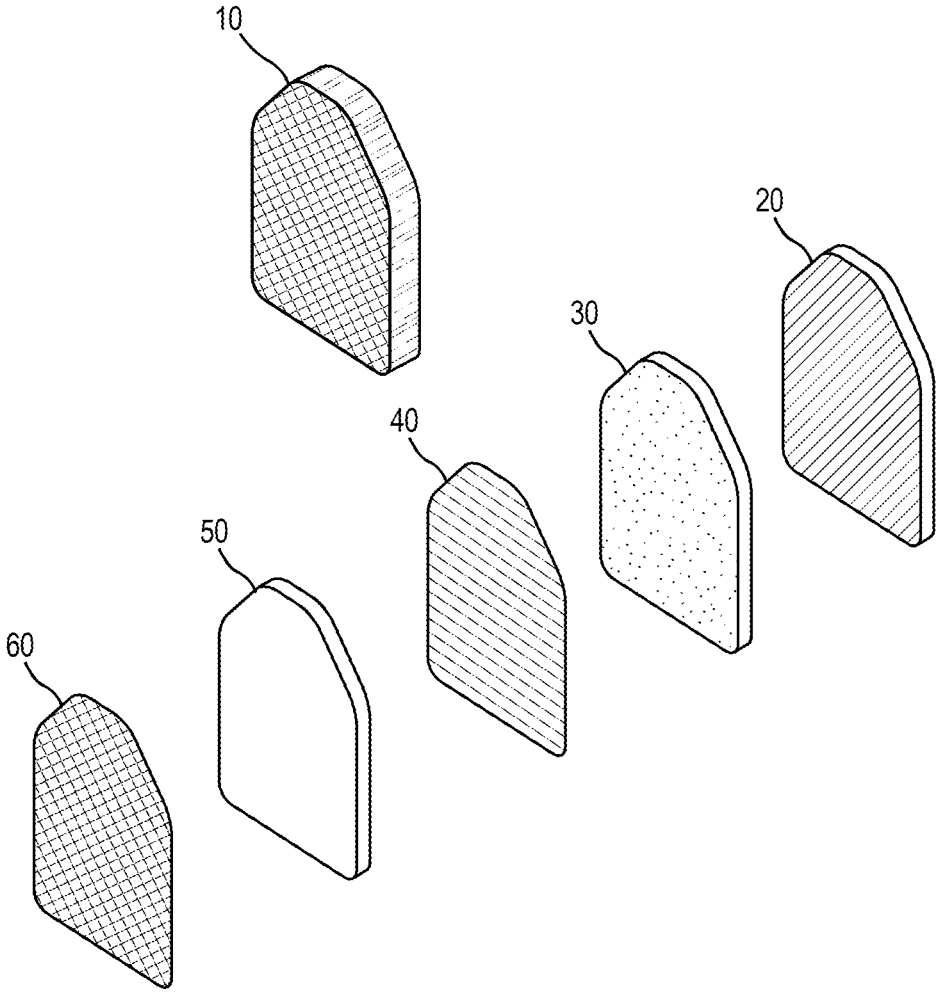
10
20
30
40
50
60

SELF-REPAIRING ARMOR

CROSS-REFERENCE TO RELATED PATENT APPLICATIONS

The present application claims priority to U.S. provisional application No. 62/070,826, filed Sep. 8, 2014, U.S. provisional application No. 62/178,013, filed Mar. 30, 2015 and U.S. provisional application No. 62/230,366, filed Jun. 5, 2015, the contents of each of which is hereby incorporated by reference herein in its entirety.

BACKGROUND

Lightweight armor for ballistic protection applications, and more specifically lightweight personal armor is used to stop high and very high ballistic threats e.g. armor piercing (AP) bullets. For efficient low weight ballistic protection against high power penetration projectile, hard armor such as hard ceramic armor in form of ceramic plates or other special shapes is needed. Ceramic armor is typically used for personal protection, vehicles protection, ships, helicopters, and aircraft protection. For personal protection, body armor including ceramic plate backed by composite material is often used. A hard armor composite includes a rigid ceramic front surface and a laminated ballistic composite material/fabric. The composite material and any fabric (e.g., from a vest) behind the ceramic plate serves to absorb the remaining energy of the bullet after hitting the ceramic facing and to "catch" the bullet, it's fragments and any ceramic fragments.

In current body armor designs, improved anti-ballistic performance is generally achieved at the expense of using thicker and therefore heavier ceramic and backface materials, reducing the mobility of the wearer. When thinner materials are used, back face deflection (also known as back face deformation or BFD) of the armor increases and may cause blunt force trauma to the user. Likewise, thinner materials have reduced abilities to withstand multi-impact attacks. Although increasingly sophisticated materials have been developed to increase anti-ballistic performance without added weight, more protective, lighter and less expensive solutions would be useful.

SUMMARY OF THE INVENTION

The present technology provides lighter-weight multi-impact armor articles suitable for use in various armor applications, including body armor, helmet armor, vehicle armor, and aircraft armor, e.g., helicopters. The armor articles include a ceramic plate having a front surface and a back surface and a polymer backer affixed to the back surface of the ceramic plate. The polymer backer includes a laminate of at least two layers of material, such as a ballistic fabric, optionally with resin. The armor articles include self-repair conduits on the front surface of the ceramic plate which are covered by a layer of material, and the self-repair conduits contain a self-repair composition. In some embodiments the self-repair conduits may also be located on the back surface of the ceramic plate and/or within the laminate of the polymer backer.

In another aspect, the present technology provides armor including at least two layers of a ballistic fabric either stitched or laminated together to form a plate having a front surface and a back surface; and self-repair conduits attached to the front surface of the plate and covered by a layer of material, wherein the self-repair conduits contain a self-repair composition.

BRIEF DESCRIPTION OF THE DRAWINGS

FIG. 1 shows an exploded view of an illustrative embodiment of an armor article of the present technology.

DETAILED DESCRIPTION

The armor articles of the present technology include a ceramic plate with a front surface (the side a projectile will first impact the plate) and a back surface. The ceramic plate may be a single unitary plate (being thinner in one dimension than its other two dimensions) or formed from a plurality of smaller ceramic tiles (which can have equivalent or different lengths for each dimension) that are bonded together as known in the art (e.g., US 2014/0230638, hereby incorporated by reference in its entirety). The ceramic plate may be made of boron carbide ($B_4C$), silicon carbide (SiC), aluminum oxide ($Al_2O_3$), titanium diboride ($TiB_2$), aluminum nitride (AlN), silicone nitride ($Si_3N_4$), or a combination of any two or more thereof. In some embodiments, the ceramic plate includes boron carbide, silicon carbide, or a mixture thereof, optionally with silica. Other carbides, borides, oxides and combinations of any two or more thereof may be used. The ceramic plate may be formed by hot pressing, bonding, sintering and other methods known in the art, and are commercially available, e.g., from CoorsTek of Golden Colo., from Ceradyne, Inc. of Costa Mesa, Calif., and from CerCo, LLC of Shreve Ohio.

The ceramic plate may have any suitable shape. For example, the overall shape of the plate may be triangular, square, rectangular, pentagonal, hexagonal, etc. The length of each side of the plate may be the same or different. Torso plates, e.g., may have six or more sides with 4 or more different lengths. Overall sizes (not including the cut-aways) for ceramic plates useful as torso plates may range from 8×12 inches to 11×14 inches or more. By way of non-limiting example, lengths and widths in inches of ceramic plates may be about 1, 2, 3, 4, 5, 6, 7, 8, 9, 10, 11, 12, 13, 14, 15, 16, 18, or 20, or a range between and including any two of the foregoing values. Thicknesses of the plates may also vary from thin (e.g., 0.1 inch) to thick (1 or 2 inches or more), e.g., about 0.1, 0.2, 0.3, 0.4, 0.5, 0.6, 0.7, 0.8, 0.9, 1.0, 1.1, 1.2, 1.3, 1.4, 1.5, 1.6. 1.7, 1.8, 1.9, or 2.0 or a range between and including any two of the foregoing values. The ceramic plates may also be flat or curved. In some embodiments, the ceramic plate is arcuate. If the plate is made of tiles, the tiles, may likewise be flat or curved, including arcuately curved. The tiles may also be comprised of two or more thinner layers, offset so that the joints between the tiles of one layer do not line up with the joints of the second or subsequent layers.

Optionally, ceramic particulates may be affixed to the front surface of the ceramic plate, the cover material or any material attached to the front surface of the ceramic plate. The ceramic particulate may include ceramic powder, chips, and/or ceramic shards. The ceramic particulate may be made of the same material as the ceramic plate or similar or different materials, e.g., boron carbide and/or silicon carbide.

The armor articles of the present technology include a polymer backer, such as a laminate of ballistic fabric. Ballistic fabric are fabrics (woven or nonwoven) of synthetic polymer fibers which exhibit resistance to penetration by projectiles. Ballistic fabrics that may be used in the polymer backer include those made from ultra-high molecular weight polyethylene (UHMWPE), para-aramid or a combination of any two or more thereof.

UHMWPE, has a weight average molecular weight from about 2 to about 6 million. In some embodiments the UHMWPE used in the present technology has a weight average molecular weight of about 2, 2.5, 3, 3.5, 4, 5 or 6 million or a weight between and including any two of the foregoing values. Commercially available UHMWPE that may be used in ballistic fabric of the present articles includes, SPECTRA and SPECTRA SHIELD (Honeywell Specialty Materials, Morristown, N.J.) and DYNEEMA (e.g., HB2, HB26, HB50, HB210, HB212; Royal DSM N.V., Netherlands). As used herein, the term "para-aramid" refers to synthetic polymers based on poly-paraphenylene amides such as poly-paraphenylene terephthalamide (e.g., KEVLAR 29, 129, KM2, XP; DuPont US). In certain applications of the present technology, nylon ballistic fabrics such as CORDURA, unidirectional (UD) E-glass or S-glass fabrics, graphite fabrics or any combination of two or more thereof or combination with UHMWPE or para-aramids may also be used.

The polymer backer is a laminate of at least 2 layers of material, i.e., ballistic fabric. In some embodiments, the polymer backer has 2 to 100 layers of material. Excellent anti-ballistic performance at low weight may be achieved with 30 to 60 layers of material, but the present technology is not so limited. Higher numbers of plies may be used, especially in vehicle and aircraft applications. Examples of the number of layers of material that may be used in the polymer backer include 2, 5, 10, 15, 20, 25, 30, 35, 40, 42, 45, 50, 52, 60, 65, 70, 75, 80, 90, 100, 200, 300, 500, 1000 or a range between and including any two of the forgoing values. The fibers in the ballistic fabric are typically oriented in one or more particular directions. To increase resistance to projectiles, the layers may be laid down on top of each other so that the selected fiber direction is offset by, e.g., 45 or 90 degrees. In certain embodiments, improved performance is obtained when each successive layer of ballistic fabric in the polymer backer laminate is offset from the previous layer by 10 to 45 degrees. For example each successive layer may be offset by 10, 15, 20, 25, 30, 35, 40 or 45 degrees or within a range between and including any two of the foregoing values.

The polymer backer laminate may be formed by conventional means (heat and/or pressure) using any suitable resin such as an epoxy resin (e.g., SC-15 from Applied Poleramic; FM73 from Cytec; EA 9628 and EA9309 from Hysol/Henkel; F161 from HEXCEL). Typically, the polymer backer is simultaneously formed and affixed to the back surface of the ceramic plate using one of the foregoing heat curable or bonding adhesives or another suitable adhesive and heating to 50-250° C. under pressures of 250-6000 psi. Backers of para-aramids may be prepared at lower temperatures and pressures, e.g., 166° C. and 250 psi, while backers of UHMWPE may be prepared at 3000 psi (e.g., TENSYLON and DYNEEMA HB50) and/or 6000 psi. In some embodiments, the polymer backer is prepared separately and subsequently affixed to the ceramic plate.

Articles of the present technology may further include a second polymer laminate affixed to the front surface of the ceramic plate or to any material adjacent to the front surface, for example the cover layer of material. The second polymer laminate may be the same or different from the polymer backer laminate, but includes two or more layers of ballistic fabric as described above or alternatively at least one layer of ballistic fabric along with layers of other types of fabric such as graphite or fiberglass. Similarly, in some embodiments the armor article may include an anti-shock layer made of foam or rubber material (e.g., 1, 2, 3, 4, 5, 6, 7, 8, 9 or 10 mm thick) inserted between the self-repair conduits and the cover material or between the self-repair conduits and the front surface of the ceramic plate. The anti-shock layer reduces ceramic fracturing and BFD.

The armor articles of the present technology also includes self-repair conduits that contain a self-repair composition. The self-repair conduits are positioned on the front surface of the ceramic plate and are covered by a layer of material to hold them in place. This cover layer of material may include a fabric and resin, e.g., a ballistic fabric, that is the same or different from the ballistic fabric used in the polymer backer or, if present, the $2^{nd}$ polymer laminate. The cover may include one or several (e.g., 2, 3, 4, 5, or 6) layers of ballistic and/or other fabrics. In some embodiments the cover material comprises nylon ballistic fabric (e.g., CORDURA having a weight anywhere from 20-1000 dennier). By "on the front surface" is meant that the self-repair conduits are either in direct contact with the front surface or are separated from the front surface by minimal intervening material so that when the conduits are impacted by a ballistic projectile, they will release the self-repair composition into the damaged area of at least the ceramic plate.

In some embodiments, the self-repair conduits are located in other positions in the armor article. For example, the self-repair conduits may be placed between the rear surface of the ceramic plate and the polymer backer or within the polymer backer. In some embodiments the articles include a first set of self-repair conduits on the front surface of the ceramic plate and a second set of self-repair conduits elsewhere in the article. For example, the polymer backer may include a second set of self-repair conduits containing a second self-repair composition. The second self-repair composition may be the same as or different from those on the front surface of the ceramic plate. Such laminates may be made by inserting the self-repair conduits containing the self-repair compositions between the ceramic plate and polymer backer or one or more layers of the ballistic fabric and carrying out the normal fabrication process. Any of the self-repair conduits or compositions described herein may be used so long as they are resistant to the high temperatures and heat employed in fabrication.

The self-repair conduits are configured to release the self-repair composition upon impact of a ballistic projectile. In some embodiments, the self-repair conduits are sealed glass tubes or fibers. Alternatively, the self-repair conduits are sealed polymeric tubes. Tubes that may be used for the self-repair conduits may have any suitable cross-sectional shape such as tubes with circular, oval, elliptical, square, rectangular, lens-like or other regular or irregular types of cross-section. The sealed polymeric tubes may be a sealed flexible package as disclosed in U.S. Pat. No. 8,877,309 (incorporated herein in its entirety) and have a roughly elliptical, lens-like or ovate cross section.

The sealed flexible package may be configured with one cell per package or may include two or more sealed cells in which the self-repair composition is disposed. The cells may be any suitable shape such as circular, oval, rectilinear, square, rectangular, pentagonal, hexagonal, or octagonal. Where the flexible packages include a plurality of sealed cells, they may be aligned in any pattern that permits them to release the self-repair composition upon impact by a ballistic projectile into the armor article. Thus, in some embodiments, at least some of the sealed cells are aligned with each other in a first direction. For example, the flexible sealed package can be a tape with multiple sealed cells arrayed in a linear fashion along its length (such as, but not limited to rectangular cells positioned end to end). In others, at least some of the sealed cells are aligned with each other in a first direction and in a second direction, different from the first direction. In some embodiments, at least some of the sealed cells are positioned in an offset relationship to one another in a first direction. Two or more layers of self-repair conduits (e.g., glass tubes or polymeric tubes such as flexible packages) may be used to ensure that adequate self-repair composition is available for release across the surface of the front surface. In some embodiments, a single large polymeric tube (e.g., plenum) containing self-repair composition may be used as the self-repair conduit.

The sealed polymeric tubes may be sealed flexible packages with walls of a metal-polymer laminate. More specifically, the sealed flexible package may include a first sheet with one or more edges; a second sheet with one or more edges; and the self-repair composition disposed between the first and second sheets. The first and second sheets are typically sealed to each other at the one or more edges, and each sheet includes a polymer (e.g., a polymer film). Alternatively, the sealed flexible package is formed from a single sheet folded over on itself and sealed where the edges meet. In some embodiments, at least one sheet of the sealed flexible package further comprises a metal (e.g., a foil). Thus, in some embodiments, each sheet may be a laminate comprising two or more layers. For example, each sheet may be laminate that includes a polymer layer and a metal foil layer or a metalized polymer layer with a self-repair composition disposed within the package. In some embodiments, the metal layer is aluminum, tin, steel or an alloy of any one of the foregoing. In other embodiments, the laminate comprises a metal foil layer between two or three polymer layers that are the same or different, e.g., between two layers of polyethylene, between polypropylene and polyethylene or between polyester and polyethylene films. In some embodiments, the sheet is a laminate having a top layer of polyester, an adhering later of polyethylene, a metal foil such as aluminum foil and a second layer of polyethylene which forms the internal surface of the package. The laminate layers may be adhered to each other by heat, adhesive, coextrusion or a combination of such methods. In some embodiments the sealed flexible packages are generally rectangular and are sealed along all four sides. In other embodiments, the sheet is folded over on itself and sealed on three sides. Each sheet, whether a laminate or single ply film or membrane may be between about 0.5 mil and about 100 mils in thickness. Examples of sheet thickness include about 0.5, about 1, about 2, about 3, about 4, about 5, about 10, about 15, about 20, about 25, about 30, about 40, about 50, about 60, about 70, about 80, about 90, and about 100 mils, or any range between and including any two of the foregoing values. For example, the sheets may range from about 5 to about 20 mils thickness. Such sheets may be formed using methods known in the art.

The sealed flexible package may be produced by filling unsealed or partially sealed packages with the self-repair composition and heat sealing, cold sealing, pressure sealing (e.g., crimping), or a combination of any two or more thereof. The flexible packages may be fabricated in a wide variety of sizes to suit the application at hand. For example, the sealed flexible packages (or cells within the packages) may be generally rectangular in shape with dimensions ranging from 0.5 cm×1 cm to 10 cm×30 cm. In some embodiments the sealed flexible packages range from 1 cm×2 cm to 5 cm×10 cm. Larger sealed flexible packages may also be used and may range from 5 cm×10 cm to 10 cm×30 cm or more, depending on the size of the article.

Polymers that may be used in sealed flexible packages of the present technology include but are not limited to nylon, polyolefin (e.g., polyethylene, polypropylene, polybutene, polyisoprene, ethylene-propylene copolymers, ethylene-octene copolymers, propylene-butene copolymers, propylene-octene copolymers, and combinations thereof), polyester, polycarbonate, polyacrylate, polyarylate, polyamide, polyimide, polyaramide, polyurethane, cellulose (including, e.g., cellulose esters), and nitrocellulose. In some embodiments, the polymer is selected from the group consisting of polyester, polyethylene and polypropylene. Other polymers that may be used in the sealed flexible packages include rubber, ethylene vinyl acetate, polyvinyl acetate, polyvinyl butyral, polyvinyl chloride polyvinyl carbonate, and ethylene vinyl alcohol. Combinations of any two or more of the forgoing may also be used. Preferably, the polymers and/or metal layer(s) are selected such that the flexible is of very low permeability or essentially impermeable to air, moisture, and a combination thereof in order to protect the integrity of the self-repair composition inside.

An interior surface of the sealed flexible package can be treated to achieve a variety of functions including, e.g., to prevent or decrease reaction of the self-repair composition before it is released from the package to perform the sealing function, altering (e.g., increasing or decreasing) the surface tension of the surface of the package, altering (e.g., increasing or decreasing) the hydrophobicity or hydrophilicity of a surface of the package, altering (e.g., increasing or decreasing) the reactivity of a surface of the package to prevent premature reaction or crosslinking of the self-repair composition with a component of the flexible packaging, and combinations thereof. In some embodiments, an interior surface of the sealed flexible package is treated with an acid to provide an acid-treated surface that will prevent or resist reaction with the self-repair composition. Acids such as muriatic acid, maleic acid, or acetic acid may be used to produce the acid-treated surface.

A self-repair composition of the present technology may exhibit one or more of the following characteristics. It may have relatively low viscosity to allow it to flow quickly into cracks and voids in the ceramic plate, between the plate and polymer backer and within the polymer backer. Examples of suitable viscosities include 1, 2, 3, 4, 5, 10, 15, 20, 30, 50, 100, 200, 300, 400, and 500 cP or may be within a range between or including any of the foregoing values. It may have a fast cure time (e.g., not more than 10, 9, 8, 7, 6, 5, 4, 3, 2, or 1 minute(s)). It may have high shear strength (e.g., 1000, 1500, 2000, 2500, 3000, 3500, 4000, 5000 psi or a range between and including any of the foregoing values). Thus, suitable self-repair compositions may include a cyanoacrylate or an epoxy adhesive. For example, the self-repair composition may include methyl-2-cyanoacrylate, ethyl-2-cyanoacrylate, n-butyl cyanoacrylate, 2-octyl cyanoacrylate, bis-2-cyanoacrylate, cyanoacrylates with silicon, fluoroalkyl-2-cyanoacrylate, aryloxy ethyl-2-cyanoacrylate, cyanoacrylates with unsaturated groups, trimethylsilyl alkyl-2-cyanoacrylate, stabilized cyanoacrylate adhesives, and stabilized cyanoacrylate adhesives disclosed in U.S. Pat. No. 6,642,337 and U.S. Pat. No. 5,530,037 (incorporated by reference in their entireties herein), and combinations of any two or more thereof. In some embodiments, the self-repair composition includes ethyl cyanoacrylate, which is widely commercially available in a number of fast curing formulations as well as slower curing ones.

Suitable epoxies for use in the present self-repair compositions include epoxy vinyl ester, one part and two part epoxies. Examples include but are not limited to phenyl glycidyl ether, cresyl glycidyl ether, and glycidyl ethers of alcohols (e.g., dodecyl alcohol)), multifunctional epoxides (e.g., epoxides of polyunsaturated organic compounds, oligomers of epihalohydrins, glycidyl derivatives of hydantoin and hydantoin derivatives, glycidyl ethers of polyvalent alcohols, glycidyl derivatives of triazines, and glycidyl ethers of polyhydric phenols (e.g., glycidyl ethers of dihydric phenols, including resorcinol, hydroquinone, bis-(4-hydroxy-3,5-difluorophenyl)-methane, 1,1-bis-(4-hydroxyphenyl)-ethane, 2,2-bis-(4-hydroxy-3-methylphenyl)-propane, 2,2-bis-(4-hydroxy-3,5-dichlorophenyl) propane, 2,2-bis(4-hydroxyphenyl)-propane (i.e., bisphenol A), and bis-(4-hydroxyphenyl)-methane (i.e., bisphenol F, which may contain varying amounts of 2-hydroxyphenyl isomers)), cycloaliphatic epoxy resins, epoxy novolac resins (i.e., glycidyl ethers of novolac resins), and combinations of any two or more thereof. In some embodiments, a mixture of self-repair conduits containing two different self-repair compositions may be used. For example, a mixture of self-repair conduits containing either a cyanoacrylate composition or a latex and solvent composition.

Various additives known in the art may be added to the self-repair compositions including but not limited to catalysts, initiators, accelerators, solvents, fillers (e.g., fibers and fibrous materials that enhance the performance of the self-repair composition), heat-resistant agents, antioxidants, colorants, thickeners, anti-corrosion agents, surfactants, and biocides.

In another aspect, the present technology provides an armor article comprising: at least two layers of a ballistic fabric either stitched or laminated together to form a plate having a front surface and a back surface; and self-repair conduits attached to the front face of the plate and covered by a layer of material, wherein the self-repair conduits contain a self-repair composition. The number and types of layers of ballistic fabric used in this armor article may be the same as described above. When laminated with a resin, such as epoxy resin, the resulting plate of ballistic fabric is relatively stiff. When sewn together, the multiple layers of ballistic fabric are more flexible and suitable for soft body armor that allows more freedom of movement.

It is contemplated that any of the embodiments of the present technology described herein may be used with any other embodiment. For example, with reference to FIG. 1, in some embodiments the armor article 10 includes a ceramic plate 30 having a front surface and a rear surface, wherein the ceramic plate comprises boron carbide, silicon carbide, or a combination thereof; a polymer backer 20 affixed to the back surface of the ceramic plate, wherein the polymer backer comprises a laminate of at least two layers of material, each layer comprising a ballistic fabric selected from an ultra-high density polyethylene ballistic fabric; and self-repair conduits 40 on the front surface of the ceramic plate and covered by a layer of material (cover material), wherein the self-repair conduits are sealed polymeric tubes that include walls of a metal-polymer laminate and which contain a self-repair composition that comprises ethyl cyanoacrylate. The cover material includes a layer of ballistic fabric 60 and optionally a layer of anti-shock foam or rubber 50. In some such embodiments, the polymer backer comprises 30 to 60 layers of ultra-high density polyethylene ballistic fabric.

In another aspect, the present technology provides armor incorporating any of the armor articles described herein. For example, the armor may be body armor, an armored helmet, armored body jacket, land vehicle armor, aircraft armor, water vehicle armor. In some embodiments, the armor is body armor and the article is part of a helmet or an insert in a wearable vest, jacket or pants. The material of the wearable vest, jacket or pants may further act to reduce back face deformation and catch both projectile fragments and ceramic plate fragments. Suitable materials may be ballistic nylon or similarly tough fabrics.

EXAMPLES

Example 1

Preparation of Body Armor Insert

As an illustrative embodiment of the present technology, a torso body armor insert designed to meet ESAPI (enhanced small arms protection insert) requirements was manufactured as follows. Medium-sized (9.5"×12.5") multi-curved ceramic torso plates made of reaction bonded boron carbide were obtained from CoorsTek (Golden, Colo.). Both 0.8" and 0.9" plates were used, as well as thinner plates. The weight and areal density of a first set of ceramic plates used is shown in Table 1 below. Either 42 or 52 plies of DYNEEMA HB50 UHMWPE were pressed together with SC15 epoxy resin to the rear surface of the of the ceramic plate at a pressure of 3,000 psi and a temperature of about 250° F. (about 166° C.). The average areal density of the backer plate was 9.17 k g/m$^2$ (1.881b/ft$^2$). The self-repair conduits (flexible packages polyethylene/aluminum foil laminates containing a low viscosity ethyl cyanoacrylate composition, with a reactive colorant that turned yellow upon cure) were attached to the front surface of the ceramic plate by laying the flexible packages horizontally (in relation to long axis) on the surface and covering with a layer of SPECTRA UHMWPE and SC15 epoxy resin (total weight on average, 60 g) using vacuum assisted resin transfer technology. The cover material was allowed to cure for about 7 hours at 25-28 inches Hg, at room temperature. A first set of 7 inserts (weighing 5.2 or 5.5 lbs) was tested in this configuration. A second set of four inserts (weighing 5.3 lbs) were wrapped with ballistic nylon (CORDURA). Control inserts were made the same way except that they lacked the self-repair conduits.

TABLE 1

| Insert No. | Plate Thickness (inches) | Ceramic Plate Wt. (kg) (lb) | Areal Density (kg/m$^2$) (lb/ft$^2$) |
|---|---|---|---|
| 1 | 0.9 | — | 24.18 |
| | | | 4.95 |
| 2 | 0.9 | 1.789 | 24.20 |
| | | 3.944 | 4.96 |
| 3 | 0.9 | 1.785 | 24.15 |
| | | 3.935 | 4.95 |
| 4 | 0.9 | 1.777 | 24.0 |
| | | 3.918 | 4.92 |
| Average | 0.9 | | 24.14 |
| | | | 4.94 |
| 5 | 0.8 | 1.636 | 22.13 |
| | | 3.607 | 4.53 |
| 6 | 0.8 | 1.618 | 21.89 |
| | | 3.567 | 4.48 |
| 7 | 0.8 | 1.648 | 22.30 |
| | | 3.633 | 4.57 |
| Average | 0.8 | 1.634 | 22.11 |
| | | 3.602 | 4.53 |

Example 2

Ballistic Testing of Armor Inserts

Both sets of inserts prepared in Example 1 were tested for ability to resist armor piercing projectiles and incendiaries. One set of tests were performed according to ESAPI specification CO/PD 04-19D 14 Jun. 2007 by certified tester HP White. The inserts were fastened to a newly conditioned clay backing and shot with three APM2s (armor piercing M2s, 30 caliber, 7.62 mm×63 mm) at a nominal velocity of 2850 feet per second (fps). The shots were directed in a triangular pattern: lower left then upper middle and the lower right. The first two shots were at 0 degrees obliquity, and the third shot was either at 0 or 30 degrees obliquity. Each shot was about 1.5 inches from an edge of the insert. In an additional test, a self-repair insert was shot with an armor piercing incendiary (API) (at 2400+fps) prior to the 3 APM2s being shot. To meet ESAPI standards, the insert must stop at least two of the APM2s and not exceed 44 mm back face deflection. Results of these tests are shown in Table 2 below.

TABLE 2

Test Results Against APM2 shots, ESAPI standard

| Insert | | | | Ballistic Threat | | Results | | | | | |
|---|---|---|---|---|---|---|---|---|---|---|---|
| | | | | | | Velocity (fps) | | Penetration (Plies) | | BFD (mm) | |
| Condition | Sample Number | Weight (lbs) | Backer Weight (lbs) | Obliquity (degrees) | Shots | Shot 1 | Shot 2 | Shot 1 | Shot 2 | Shot 1 | Shot 2 |
| | | | | | | Shot 3 | | Shot 3 | | Shot 3 | |
| Ambient | 1 | 5.33 | 2.10 | 0 | 2 | 2898 | 2873 | 0 | 34 | 43.566 | Fail |
| | | | | 30 | 1 | 2864 | | 0 | | 39.931 | |
| | 2 | 5.34 | 2.09 | 0 | 2 | 2866 | 2862 | 0 | 0 | 42.113 | 33.165 |
| | | | | 0 | 1 | 2868 | | 0 | | 40.753 | |
| | 3 | 5.29 | 2.09 | 0 | 2 | 2888 | 2880 | 0 | 0 | 44.442 | 35.025 |
| | | | | 0 | 1 | 2864 | | 0 | | 40.186 | |
| | 4 | 5.39 | 2.10 | 0 | 2 | 2880 | 2860 | 0 | 0 | 41.221 | 34.906 |
| | | | | 0 | 1 | 2885 | | 0 | | 40.013 | |
| | A | 5.42 | 2.10 | 0 | 2 | 2900 | 2896 | 0 | 34 | 37.666 | Fail |
| | | | | 30 | 1 | 2858 | | 0 | | 37.940 | |
| | B | 5.42 | 2.10 | 0 | 2 | 2892 | 2901 | 0 | 0 | 35.964 | 32.774 |
| | | | | 0 | 1 | 2888 | | 7 | | Fail | |

As shown in Table 2, the inserts defeated 11 of 12 APM2 projectiles (entries 1-4), including two inserts that defeated three 0 degree obliquity shots. In contrast, the heavier commercial body armor inserts defeated only 4 of 6 (entries A, B). BFD was 44 mm or less for the self-repair articles.

A second set of inserts (5.2 and 5.5 lb inserts) were shot in a similar fashion to the first test set except that all of the shots were clustered in the same area of the panel, 1 inch apart. One of the 5.5 lb. inserts was subsequently shot with three PS balls (7.62 mm×39 mm at 2400 fps) 1 inch apart to assess how close to the APM2 impact locations the PS balls could be shot to the APM2 impact location and still be stopped. After the shots, a visual inspection of the inserts was made to determine whether the projectiles were stopped (pass) or not (fail). The back face deformation was measured in millimeters. The results of these tests for these tests are in Table 3.

TABLE 3

Test Results Against APM2 shots

| Test No. | Target | Shot No. | Time | Velocity (fps) | Pass/ Fail | BFD (mm) | Weight (lbs) |
|---|---|---|---|---|---|---|---|
| 1 | 4SR | 1 | 0.5302 | 2829 | Pass | 32 | 5.5 |
| 2 | 4SR | 2 | 0.5288 | 2837 | Pass | 29 | |
| 3 | 4SR | 3 | 0.528 | 2841 | Pass | 30 | |
| 4 | 5SR | 1 | 0.529 | 2836 | Pass | 35 | 5.2 |
| 5 | 5SR | 2 | 0.5338 | 2810 | Pass | 26 | |
| 6 | 5SR | 3 | 0.5185 | 2893 | Pass | 31 | |
| 7 | 6SR | 1 | 0.5235 | 2865 | Pass | 32 | 5.2 |
| 8 | 6SR | 2 | 0.5307 | 2826 | Pass | 30 | |
| 9 | 6SR | 3 | 0.5253 | 2856 | Pass | 29 | |
| 10 | 1SR | 1 | 0.5252 | 2856 | Pass | 32 | 5.5 |
| 11 | 1SR | 2 | 0.5294 | 2833 | Fail | — | |
| 12 | 1SR | 3 | 0.5244 | 2874 | Pass | 31 | |
| 13 | 2C | 1 | 0.5309 | 2825 | Pass | 32 | 5.5 |
| 14 | 2C | 2 | 0.5211 | 2879 | Pass | 34 | |
| 15 | 2C | 3 | 0.5285 | 2838 | Pass | 31 | |
| 16 | 3C | 1 | 0.5227 | 2870 | Pass | 33 | 5.5 |
| 17 | 3C | 2 | 0.5249 | 2858 | Pass | 36 | |

TABLE 3-continued

Test Results Against APM2 shots

| Test No. | Target | Shot No. | Time | Velocity (fps) | Pass/ Fail | BFD (mm) | Weight (lbs) |
|---|---|---|---|---|---|---|---|
| 18 | 3C | 3 | 0.5283 | 2839 | Pass | 31 | |
| 19 | 7C | 1 | 0.5221 | 2873 | Pass | 32 | 5.2 |
| 20 | 7C | 2 | 0.5219 | 2874 | Pass | 35 | |
| 21 | 7C | 3 | 0.525 | 2857 | Pass[1] | 26 | |

[1]Ceramic plate separated from backer.

The results for inserts with the clustered shot pattern (Table 3) where similar or better, with the self-repair inserts stopping all but one of the APM2 shots. The self-repair inserts stopped 20 of 21 APM2 projectiles and had significantly less than 43 mm BFD. With respect to the first shot, the self-repair inserts and controls both exhibited an average BFD of 33 mm. On the second shot, the self-repair inserts exhibited less BFD than the controls (28 mm versus 35 mm) than on the first, indicating a stiffening effect from the self-repair. Visual inspection of the self-repair inserts compared to controls showed reduced radial crack extension and no delamination of backer plate from the ceramic plate. The API was also defeated with less than 43 mm BFD.

EQUIVALENTS

While certain embodiments have been illustrated and described, a person with ordinary skill in the art, after reading the foregoing specification, can effect changes, substitutions of equivalents and other types of alterations to the components of the present technology, including ceramics, polymers and self-repair conduits and compositions. Each aspect and embodiment described above can also have included or incorporated therewith such variations or aspects as disclosed in regard to any or all of the other aspects and embodiments.

The present technology is also not to be limited in terms of the particular aspects described herein, which are intended as single illustrations of individual aspects of the present technology. Many modifications and variations of this present technology can be made without departing from its spirit and scope, as will be apparent to those skilled in the art. Functionally equivalent methods within the scope of the present technology, in addition to those enumerated herein, will be apparent to those skilled in the art from the foregoing descriptions. Such modifications and variations are intended to fall within the scope of the appended claims. It is to be understood that this present technology is not limited to particular methods, materials, compositions, or applications, which can, of course, vary. It is also to be understood that the terminology used herein is for the purpose of describing particular aspects only, and is not intended to be limiting. Thus, it is intended that the specification be considered as exemplary only with the breadth, scope and spirit of the present technology indicated only by the appended claims, definitions therein and any equivalents thereof.

The embodiments, illustratively described herein may suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

In addition, where features or aspects of the disclosure are described in terms of Markush groups, those skilled in the art will recognize that the disclosure is also thereby described in terms of any individual member or subgroup of members of the Markush group. Each of the narrower species and subgeneric groupings falling within the generic disclosure also form part of the invention. This includes the generic description of the invention with a proviso or negative limitation removing any subject matter from the genus, regardless of whether or not the excised material is specifically recited herein.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents (for example, journals, articles and/or textbooks) referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims, along with the full scope of equivalents to which such claims are entitled.

What is claimed is:

1. An armor article comprising:

a ceramic plate having a front surface and a rear surface;

a polymer backer affixed to the rear surface of the ceramic plate, wherein the polymer backer comprises a laminate of at least two layers of material, each layer comprising a ballistic fabric; and self-repair conduits on the front surface of the ceramic plate and covered by a layer of material, wherein the self-repair conduits contain a self-repair composition.

2. The article of claim 1 wherein the ceramic plate comprises boron carbide, silicon carbide, aluminum oxide, titanium diboride, aluminum nitride, silicone nitride, or a combination of any two or more thereof.

3. The article of claim 1 wherein the ceramic plate comprises boron carbide, silicon carbide, or a mixture thereof with silica.

4. The article of claim 1 wherein the ceramic plate is arcuate.

5. The article of claim 1 wherein ceramic particulates are affixed to the front surface of the ceramic plate, the cover material or any material attached to the front surface of the ceramic plate.

6. The article of claim 5 wherein the ceramic particulate comprises ceramic powder, chips, and/or ceramic shards.

7. The article of claim 5 wherein the ceramic particulate is a boron carbide and/or silicon carbide particulate.

8. The article of claim 1 wherein the ballistic fabric comprises ultra-high density polyethylene, para-aramid or a combination thereof.

9. The article of claim 1 wherein the polymer backer comprises 2 to 100 layers of material.

10. The article of claim 1 wherein the polymer backer comprises 30 to 60 layers of material.

11. The article of claim 1 wherein each successive layer of ballistic fabric in the polymer backer laminate is offset from the previous layer by 10 to 45 degrees.

12. The article of claim 1 wherein the laminate comprises epoxy resin.

13. The article of claim 1 wherein the polymer backer comprises self-repair conduits containing a second self-repair composition.

14. The article of claim 1 further comprising a second polymer laminate affixed to the front surface of the ceramic plate or to any material adjacent to the front surface, wherein the second polymer laminate comprises at least two layers of material, each layer comprising ballistic fabric.

15. The article of claim 1 wherein the cover layer of material comprises a fabric and resin.

16. The article of claim 15 wherein the cover material comprises nylon ballistic fabric.

17. The article of claim 1 wherein the repair composition comprises a cyanoacrylate or an epoxy.

18. The article of claim 1 wherein the repair composition comprises ethyl cyanoacrylate.

19. The article of claim 1 wherein the self-repair conduits are sealed glass tubes or fibers.

20. The article of claim 1 wherein the self-repair conduits are sealed polymeric tubes.

21. The article of claim 20 wherein the sealed polymeric tubes comprise walls of a metal-polymer laminate.

22. The article of claim 21 wherein the ceramic plate comprises boron carbide, silicon carbide, or a combination thereof;

each layer of ballistic fabric is selected from an ultra-high density polyethylene ballistic fabric; and the self-repair composition comprises ethyl cyanoacrylate.

23. The article of claim 22 wherein the polymer backer comprises 30 to 60 layers of ultra-high density polyethylene ballistic fabric.

24. Armor comprising the article of claim 1.

25. The armor of claim 24, wherein the armor is body armor, an armored helmet, armored body jacket, land vehicle armor, aircraft armor, water vehicle armor.

26. The armor of claim 25 wherein the article of claim 1 is an insert in a helmet or wearable vest, jacket or pants.

27. An armor article comprising:

a ceramic plate having a front surface and a rear surface;

a polymer backer affixed to the rear surface of the ceramic plate, wherein the polymer backer comprises a laminate of at least two layers of material, each layer comprising a ballistic fabric; and self-repair conduits on the front surface of the ceramic plate and covered by a layer of material, on the rear surface of the ceramic plate, and/or within the polymer backer, wherein the self-repair conduits contain a self-repair composition.

* * * * *